US007563151B2

(12) United States Patent
Leonov et al.

(10) Patent No.: US 7,563,151 B2
(45) Date of Patent: Jul. 21, 2009

(54) TOY VEHICLE WITH BIG WHEEL

(75) Inventors: Vladimir Leonov, San Pedro, CA (US); David S. Bowen, Hermosa Beach, CA (US)

(73) Assignee: Mattel, Inc., El Segundo, CA (US)

( * ) Notice: Subject to any disclaimer, the term of this patent is extended or adjusted under 35 U.S.C. 154(b) by 492 days.

(21) Appl. No.: 11/257,763

(22) Filed: Oct. 25, 2005

(65) Prior Publication Data

US 2006/0211332 A1 Sep. 21, 2006

Related U.S. Application Data

(60) Provisional application No. 60/662,204, filed on Mar. 16, 2005.

(51) Int. Cl.
*A63H 17/36* (2006.01)

(52) U.S. Cl. ..... 446/460; 446/437; 446/465; 446/456

(58) Field of Classification Search ..... 446/460–468, 446/457, 448, 454–456; 180/9.3, 9.26, 6.62, 180/6.2, 6.67
See application file for complete search history.

(56) References Cited

U.S. PATENT DOCUMENTS

| | | | | |
|---|---|---|---|---|
| 3,667,156 | A | 6/1972 | Tomiyama et al. | |
| 3,733,739 | A | 5/1973 | Terzian | |
| 4,505,346 | A | 3/1985 | Mueller | |
| 4,541,814 | A * | 9/1985 | Martin | 446/456 |
| 4,666,420 | A | 5/1987 | Nagano | |
| 4,693,696 | A | 9/1987 | Buck | |
| 4,892,503 | A | 1/1990 | Kumazawa | |
| 5,533,921 | A | 7/1996 | Wilkinson | |
| 5,618,219 | A | 4/1997 | Simone et al. | |
| 5,667,420 | A | 9/1997 | Menow et al. | |
| 5,919,075 | A | 7/1999 | George et al. | |
| 6,024,627 | A | 2/2000 | Tilbor et al. | |
| 6,066,026 | A | 5/2000 | Bart et al. | |
| 6,095,890 | A | 8/2000 | George et al. | |
| 6,129,607 | A | 10/2000 | Hoeting et al. | |
| 6,227,934 | B1 | 5/2001 | Isaksson et al. | |
| 6,439,948 | B1 | 8/2002 | Ostendorff et al. | |
| 6,475,059 | B1 * | 11/2002 | Lee | 446/454 |
| 6,540,583 | B1 | 4/2003 | Hoeting et al. | |
| 6,648,722 | B2 * | 11/2003 | Lynders et al. | 446/437 |
| 6,752,684 | B1 | 6/2004 | Lee | |
| 6,764,374 | B2 | 7/2004 | Tilbor et al. | |
| 7,261,615 | B2 * | 8/2007 | Hoeting et al. | 446/456 |

OTHER PUBLICATIONS

1996 Mattel Catalog, p. 123.

* cited by examiner

*Primary Examiner*—Peter DungBa Vo
*Assistant Examiner*—Alex F R P Rada, II
(74) *Attorney, Agent, or Firm*—Panitch Schwarze Belisario & Nadel LLP

(57) ABSTRACT

A toy vehicle includes a driven wheel, a drive assembly including a drive motor, and a steering assembly including a first steering motor and first and second steering arms. The drive motor is coupled to the driven wheel. The first and second steering arms are coupled to the steering motor. The drive motor drives rotation of the drive assembly relative to the driven wheel, and the steering motor drives rotation of the first and second steering arms relative to the drive assembly. Preferably, a second steering motor is provided, and rotation of the first and second steering arms may be independently controlled.

25 Claims, 9 Drawing Sheets

TOY VEHICLE WITH BIG WHEEL

CROSS-REFERENCE TO RELATED APPLICATIONS

This application claims benefit of U.S. Provisional Patent Application No. 60/662,204, "Toy Vehicle With Big Wheel", filed Mar. 16, 2005.

FIELD OF THE INVENTION

The present invention relates to toy vehicles and more particularly, the present invention relates to a toy vehicle with a single big wheel.

BACKGROUND OF THE INVENTION

Some toy vehicles try to simulate real vehicles for entertainment value. More imaginary toy vehicles try to provide features never seen in real vehicles for entertainment value. One form of imaginary toy vehicle is a large, motorized wheel.

A first type of motorized wheel is disclosed in U.S. Pat. No. 6,066,026. Here, two generally cylindrical, hollow wheels are connected together with their circular open ends facing each other to give the appearance of one large single wheel having a central groove in its circumferential outer (road) surface. Each cylindrical wheel contains its own drive motor, the motors being mounted in a central support structure substantially or essentially surrounded by the two wheels. The central support structure further mounts a power supply also surrounded by the two wheels and an antenna which extends outwardly from the support member and between the wheels to form a "tail" extending from the middle of the large, single wheel.

A second type of motorized wheel toy is shown in U.S. Pat. No. 3,667,156. A large single wheel houses a motor mounted to drive an axle through the center of the wheel. The internal chassis with the motor is weighted so as to drop as low as possible on the axle so the motor and chassis resist internal rotation while the wheel is rotated by the motor.

Neither type of wheel is known to be able to perform any stunts. It is believed that a different single wheel type of toy having a different construction and operation would have significant new and different entertainment value than existing toys and that value would be increased if the toy had other performance capabilities.

BRIEF SUMMARY OF THE INVENTION

Briefly stated, a preferred embodiment of the present invention is directed to a toy vehicle comprising a driven wheel having first and second lateral sides, a central axis of rotation through the lateral sides, and inner and outer circumferential sides around the central axis. A drive assembly is operably mounted on the driven wheel. The drive assembly includes a drive motor and a drive member operably spaced radially from the central axis of rotation and coupling the drive motor with the driven wheel along at least one of the first and second lateral and inner and outer circumferential sides of the driven wheel. A steering assembly is operably mounted on the driven wheel. The steering assembly includes a first steering arm supported for rotation with respect to the driven wheel and supporting a first steering wheel for rotation on the first lateral side of the driven wheel. A second steering arm is supported for rotation with respect to the driven wheel and supporting a second steering wheel for rotation on the second lateral side of the driven wheel. A first steering motor is operably coupled with at least the first steering arm to rotate at least the first steering arm relative to the driven wheel so as to effect steering of the driven wheel with at least the first steering arm and first steering wheel.

BRIEF DESCRIPTION OF THE SEVERAL VIEWS OF THE DRAWINGS

The following detailed description of preferred embodiments of the invention will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
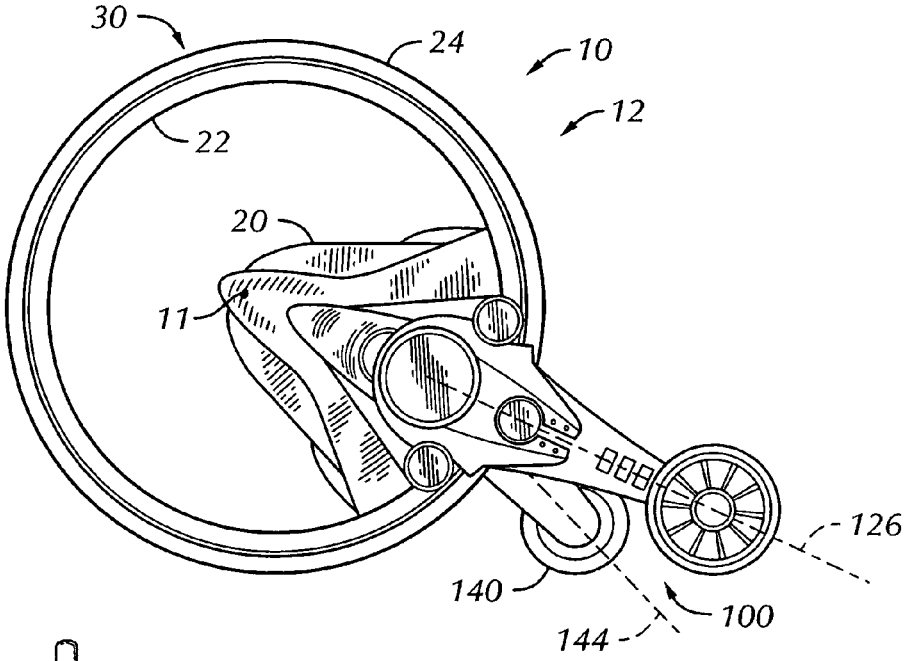
FIG. 1 is a side perspective view of a first preferred embodiment of a toy vehicle with a big wheel in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of toy vehicle, and designated parts thereof. The terminology includes the words noted above, derivatives thereof and words of similar import.

Figure 1A:
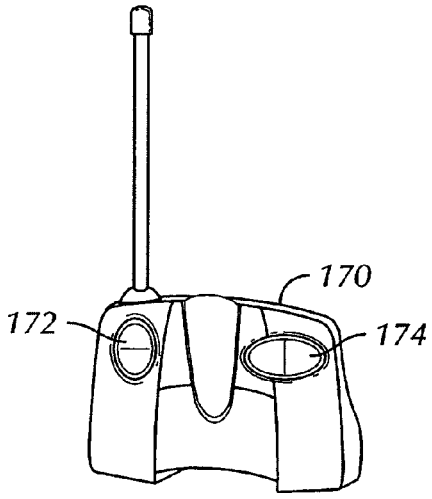
FIG. 1A is a wireless controller for the toy vehicle of FIG. 1.
Figure 2:
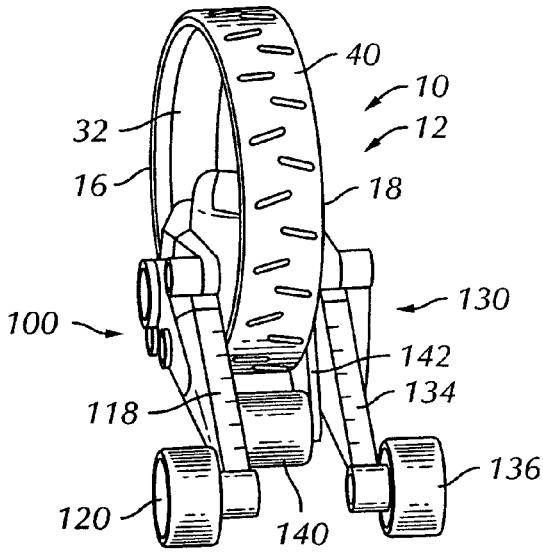
FIG. 2 is a rear perspective view of the toy vehicle of FIG. 1.

Referring to the drawings in detail, where like numerals indicate like elements throughout, there is shown in FIGS. 1-9B a first preferred embodiment of the toy vehicle generally designated 10, in accordance with the present invention. The toy vehicle 10 is preferably operably controllable by a wireless remote control unit 170 in FIG. 1A. The depicted vehicle 10 preferably comprises a vehicle body 20, and preferably is supported on a supporting surface by a single large driven wheel 30 (the "big wheel"), a first steering arm assembly 100 with a first steering wheel 120 and a second steering arm assembly 130 with a second steering wheel 136. Referring to FIG. 2, the vehicle 10 and driven wheel 30 each have opposing first and second lateral sides 16, 18, respectively. The driven wheel 30 also has opposing inner and outer circumferential sides 22, 24, respectively. Preferably, the driven wheel 30, the first steering wheel 120, and the second steering wheel 136 provide three points of contact with the ground or any other surface upon which the vehicle 10 is supported. As further described below, the vehicle body 20 preferably houses a drive assembly 50 (see FIGS. 4 and 5) mounted on and operably coupled to the driven wheel 30, a steering assembly 80 (see FIGS. 3 and 4) mounted on and coupled to the driven wheel 30 preferably through the drive assembly 50 and operably coupled to the first and second steering wheels 120, 136 by first and second steering arms 118, 134, respectively, and control electronics 150 (see FIG. 8) responsive to the remote control unit 170 for controlling the drive assembly 50 and the steering assembly 80 to drive and steer the driven wheel 30.

The vehicle body 20 may have any construction and form. A two-piece shell construction is illustrated with a generally triangular shape. The depicted body 20 is sized and configured to have one of the vertices generally coincident with the rotational axis of the driven wheel 30 and to have an arcuate side between the remaining two vertices generally corresponding to a portion of an inner circumferential side 22 of the driven wheel 30. The vehicle 10 may also have other geometric configurations that extend beyond the outer diameter of the driven wheel 30 and are spaced from the central axis of notation 11 of the driven wheel 30 but the body 20 may be omitted, if desired. The vehicle body 20 is mounted to the drive assembly 50.

A reaction wheel 140 for opposing the rotational force applied by the drive assembly 50 to the driven wheel 30 preferably is mounted to the one driven wheel 30 by being attached to the drive assembly 50, preferably through the vehicle body 20, by at least one and preferably two reaction wheel supports 142. Supports 142 position the reaction wheel 140 in the plane of the driven wheel 30 at a distance from the central axis of rotation 11 beyond the outer circumferential side 24 of the driven wheel 30. A central longitudinal axis 146 extends along the length of each reaction wheel support 142.

Figure 3:
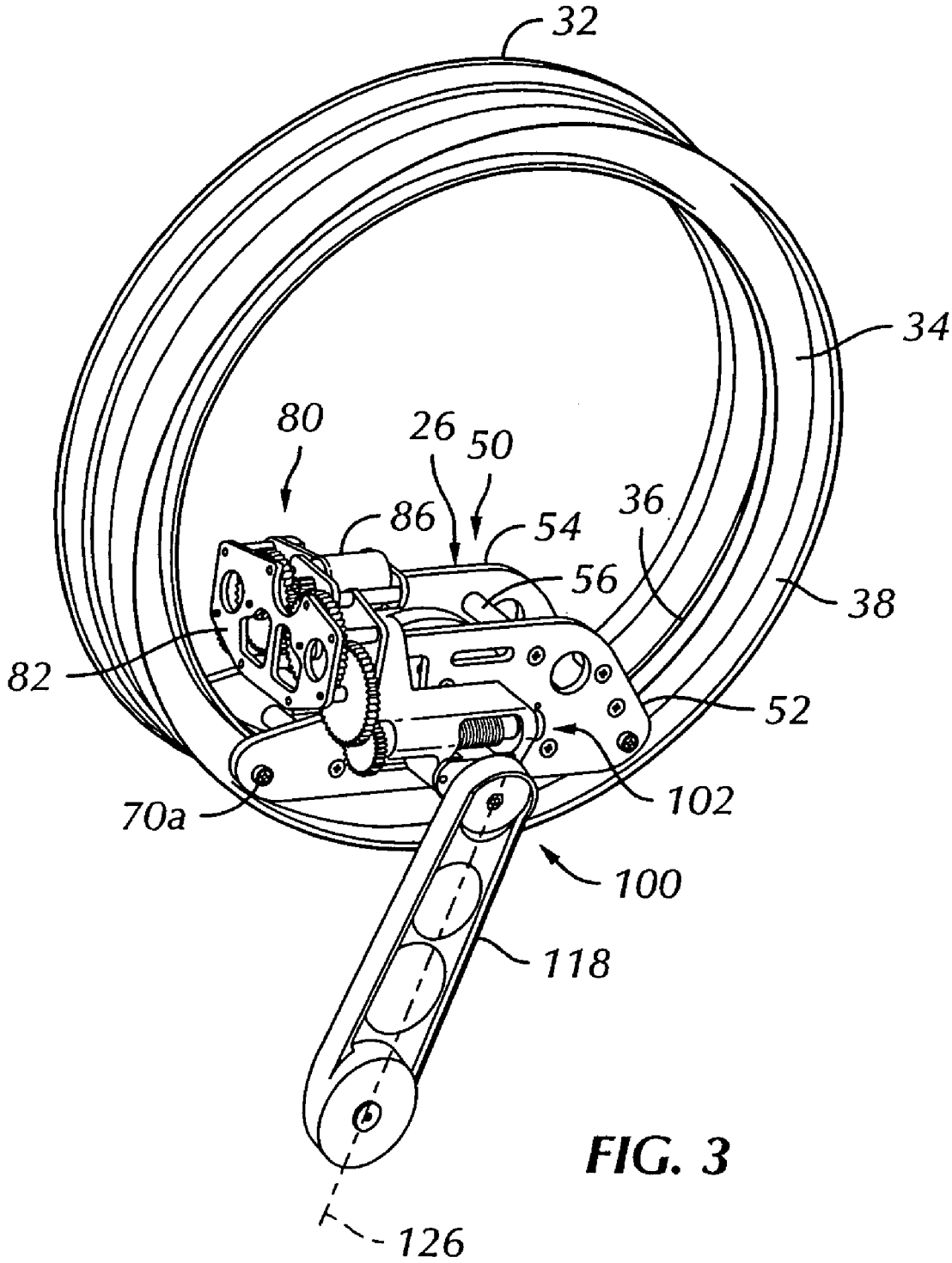
FIG. 3 is a partial fragmentary side perspective view of a portion of the toy vehicle of FIG. 1 showing a hub of a driven wheel, a drive assembly, and a portion of a steering assembly.

Referring to FIGS. 1-3, the driven wheel 30 has a substantially larger outer diameter than the outer diameter of the steering wheels 120, 136 and reaction wheel 140. The driven wheel 30 preferably has a diameter more than twice as great, suggestible more than three times as great and preferably at least four or more times as great as the diameters of the steering and reaction wheels 120, 136, 140. The driven wheel 30 has an outer diameter of at least a foot (over 30 cm), but may have a diameter greater or less than that. The driven wheel 30 preferably includes a rim 32 and a tire 40 mounted to the rim 32 and is without a hub within the rim. The rim 32 preferably includes annular channels 34 on either lateral side 16, 18, and a drive wheel groove 36. The rim 32 may be a two piece construction as shown in FIG. 3 joined along a central plane perpendicular to a central axis rotation 11 of the wheel 30. Alternatively, the rim 32 or the entire driven wheel 30 may be a one piece construction. Although the rim 32 preferably is a molded (or die-formed) polymeric product, the rim 32 may be fabricated from other materials such as metal by other well known manufacturing processes such as milling. The channels 34 provide structures for operably coupling the driven wheel 30 with the drive assembly 50 as further discussed below. The drive wheel groove 36 is preferably formed in the inner circumferential side 22 of rim 34, and provides a contacting surface for frictional engagement with a drive wheel 68, as described below. However, any suitable surface including one without a groove can be provided for engagement with drive wheel 68. The tire 40 is preferably formed from a material with flexible properties with high impact durability and is also soft enough to provide traction on a wide variety of surfaces on which the vehicle 10 is driven.

Figure 4:
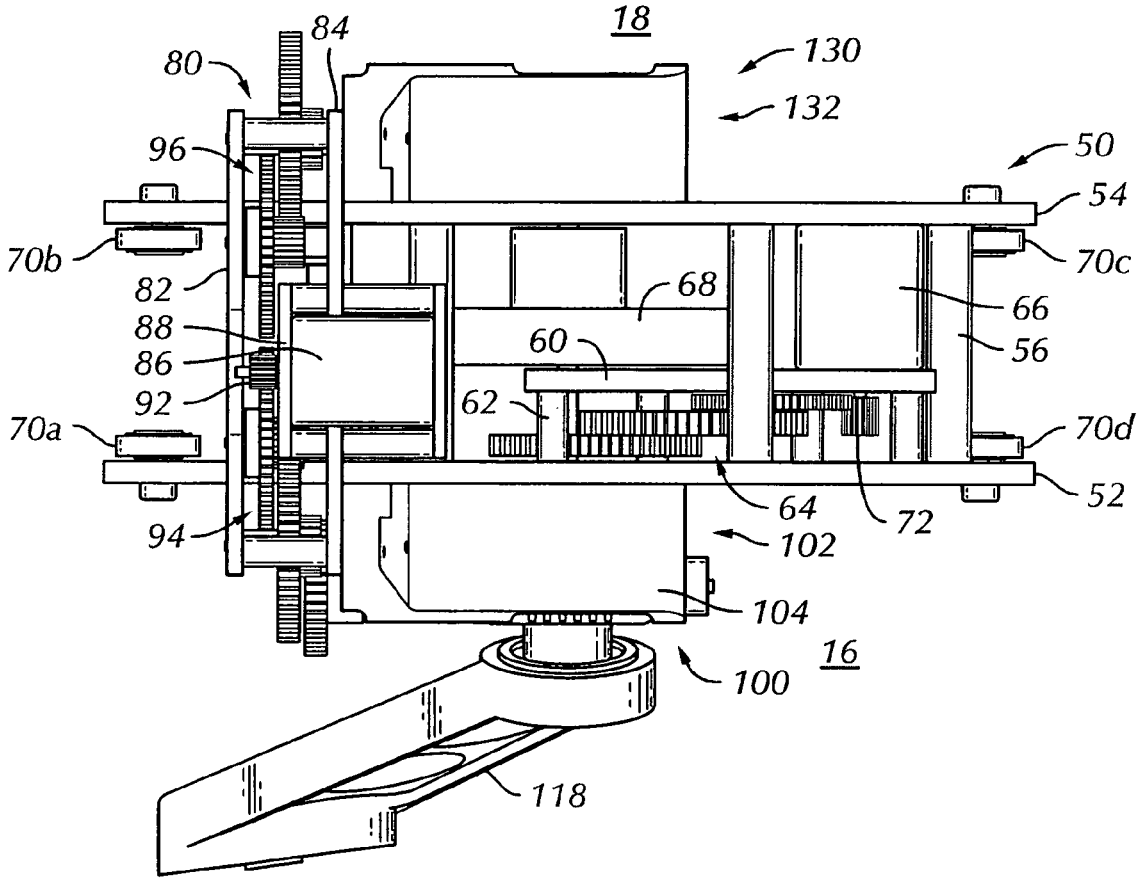
FIG. 4 is a top plan view of the drive assembly and the portion of the steering assembly of FIG. 3.
Figure 5:
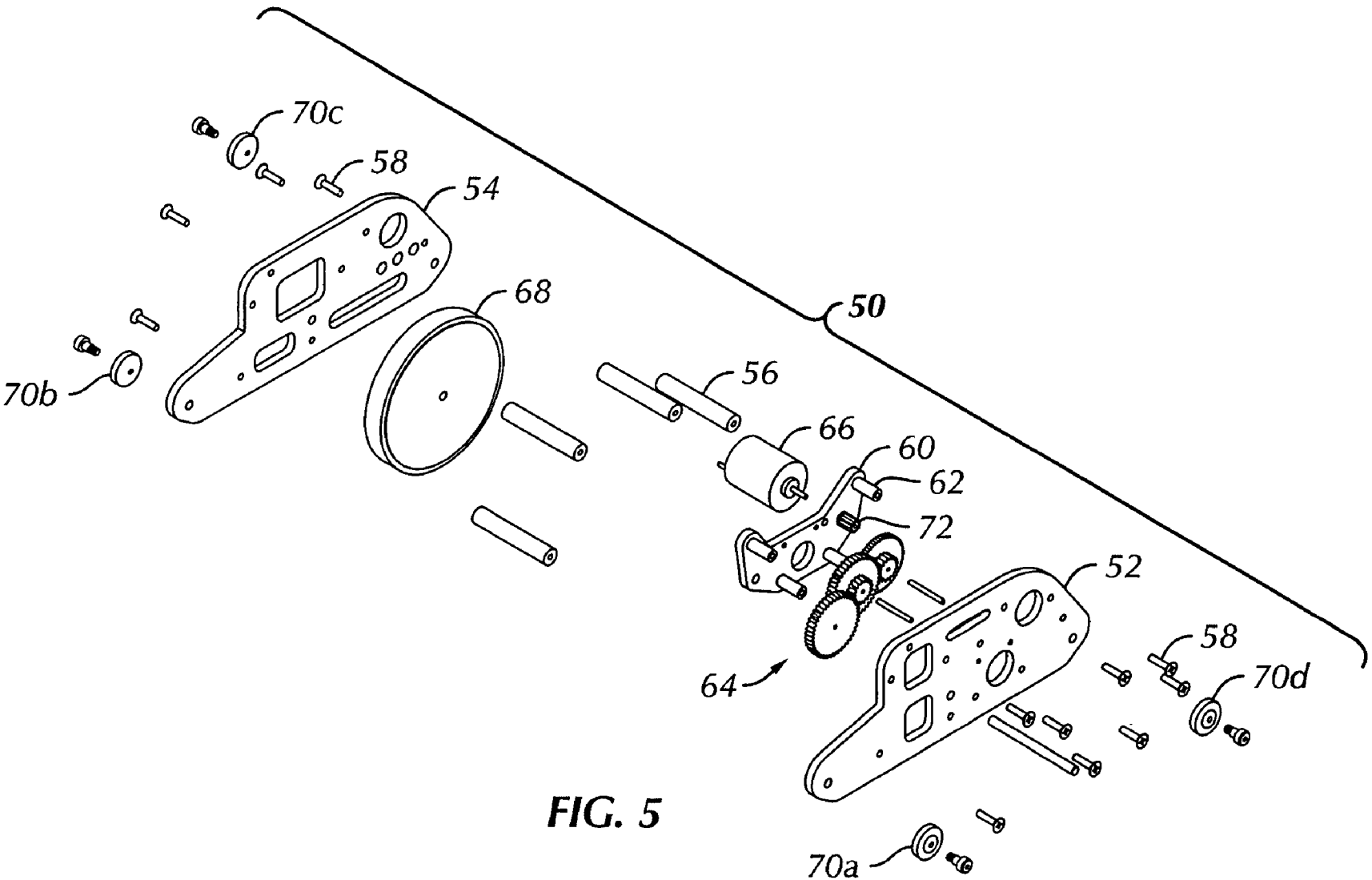
FIG. 5 is an exploded perspective view of the drive assembly of the toy vehicle of FIG. 1.
Figure 7:
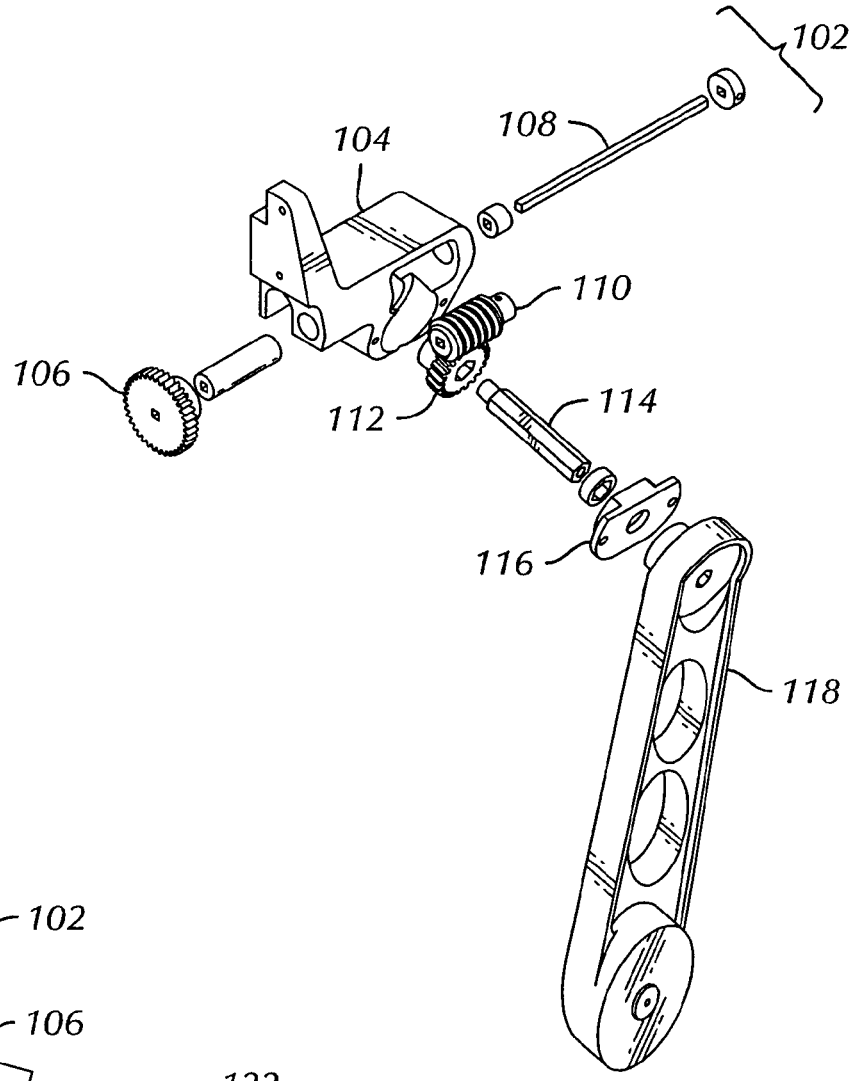
FIG. 7 is an exploded perspective view of the portion of the steering assembly of FIG. 6.
Figure 6:
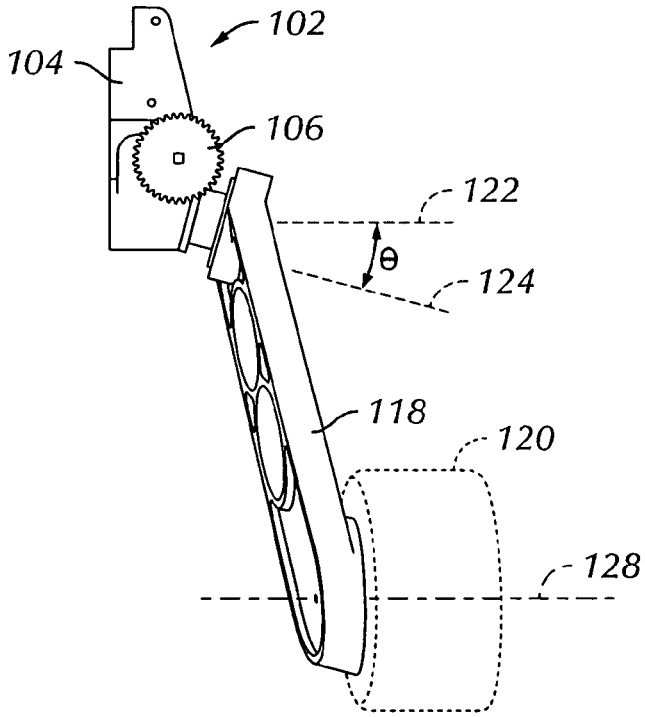
FIG. 6 is front elevation view of the portion of the steering assembly of FIGS. 3 and 4.

Referring to FIGS. 3-5, the drive assembly 50 preferably includes a drive motor 66 that rotates the drive wheel (or other drive member) through a drive assembly reduction gear train 64. The drive motor 66 is supported within the vehicle body 20 by a frame 26 comprising first and second plates 52, 54, which are spaced apart by spacer rods 56 and held together by fasteners 58. First and second pairs of idler wheels 70*a*-70*d* are rotatably attached to the drive assembly plates 52, 54. The idler wheels 70*a*-70*d* operably couple the drive assembly 50 to the rim 32. The idler wheels 70*a*-70*d* are spaced sufficiently apart and configured to be retained in the channels 34, bearing against the outer circumferential sides of annular flanges 38 such that the drive wheel 68 presses against and rotates the driven wheel 30 by frictional engagement. In an alternative drive assembly embodiment (not shown), the drive wheel 68 may be replaced by a drive gear (not shown) that meshes with a gear formed on the inner circumference of the rim 32.

Referring to FIGS. 3 and 4, a first embodiment steering assembly 80 preferably is mounted on and supported from the drive assembly 50 and includes a first steering motor 86 operably coupled to the first and second steering arm assemblies 100,130. The first steering motor 86 has an output shaft provided with a pinion 92, which is operably engaged with a first steering arm gear train 94 and a second steering arm gear train 96, both preferably reduction spur gear trains. Preferably, the first steering motor 86 is supported by first and second mount plates 88, 90, and by first and second steering motor housing plates 82, 84. The first steering motor 86 drives the first steering arm gear train 94 and the second steering arm gear train 96 such that first steering arm 118 and second steering arm 134 are driven in opposite directions at the same speed and same angular extent as further discussed below.

Although configured for operation on opposite lateral sides 16, 18 of the vehicle body 20, the first and second steering arm assemblies 100, 130 at least have substantially the same structure and operate in substantially the same way. Preferably, they are mirror images. Accordingly, for drawing simplicity and disclosure brevity, only portions of the first steering arm assembly 100 are shown in FIGS. 3, 4, 6, and 7 and is discussed below.

The first steering arm assembly 100 includes a first gearbox assembly 102 having a first gearbox housing 104. A first gearbox input gear 106 operably engages an output gear of the first steering arm gear train 94, and is rotatably fixed on shaft 108 for rotation relative to the first gearbox housing 104 with the shaft 108. A worm 110 is rotatably fixed on the shaft 108, and rotates with shaft 108 and input gear 106. The worm 110 provides a further gear reduction that operates to hold the first steering arm 118 in position when the first steering motor 86 is off. The worm 110 drives a worm gear 112 rotatably fixed on a shaft 114, to which the first steering arm 118 is also rotatably fixed. A side plate 116 retains the worm gear 112 within the first gearbox housing 104.

Referring to FIG. 2, when the steering arms 118 and 134 are in the trailing position with the driven wheel 30 upright and essentially perpendicular to a horizontal surface supporting all three wheels 30, 130, 126, arms 118 and 136 are parallel to one another and to the central diametric plane of the driven wheel 30. However, steering arm 118 has an axis of rotation 124 that is preferably pitched or tilted at an angle θ with respect to an axis 122 extending parallel to an axis of rotation 11 of the driven wheel 30. Given the tilt angle θ, the first steering arm 118 and the first steering wheel 120 rotate in planes which are non-parallel to a plane of rotation of the driven wheel 30. The depicted tilted orientation permits the vehicle 10 to right itself when fallen to one side. This can be done by rotation of the driven wheel 30 and steering arm assembly 100,130 under the driven wheel 30. However, the first and steering arms 118,136 and their wheels 120,138 can all be configured to rotate in planes parallel to one another and to that of the driven wheel 30 if some performance capability is sacrificed.

Figure 8:
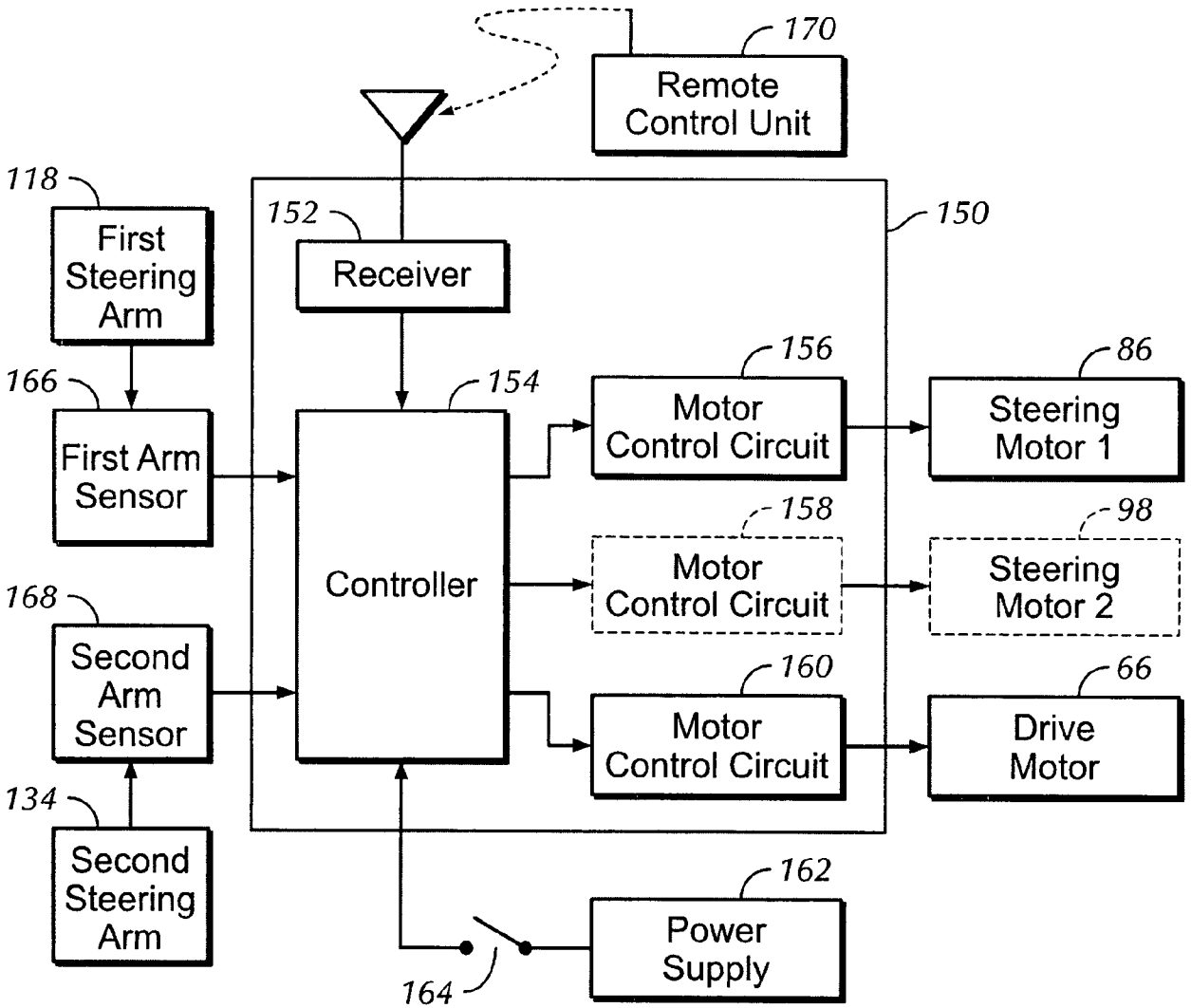
FIG. 8 is a block diagram of electrical components of the first embodiment toy vehicle of FIG. 1, also showing potential modifications to the first embodiment toy vehicle which result in a second embodiment toy vehicle.

With reference to FIG. 8, control electronics 150 of the toy vehicle 10 include a receiver 152 adapted to received wireless signals from a transmitter (not illustrated) included with the remote control unit 170. The receiver 150 relays signals to a controller 154, which receives power from a power supply 162 housed within the vehicle body 20. The power supply 162 may be connected to the controller 154 by a power switch 164. The controller 154 is operatively coupled to a first motor control circuit 156 which controls operation of first steering motor 86. The controller 154 is also operatively coupled to a drive motor control circuit 160, which controls operation of drive motor 66. First and second arm sensors 166, 168, respectively, may be provided and operably coupled to the controller 154 to provide information regarding position of the first and second steering arms 118, 134 relative to the drive assembly 50, in order to keep the movement of the first and second steering arms within preset limits or to control movement of the arms 118,136 to predetermined positions between the reset limits or to synchronize movement of the first and second steering arms 118, 134 if separately controlled steering motors are provided.

Referring to FIGS. 1 and 8, the drive motor 66 and the first steering motor 86 may be remotely controlled by the remote control unit 170. The remote control unit 170 may be any standard radio frequency controller having a first three position switch 172 for controlling the forward and backward movement of the vehicle 10 and a second three position switch 174 for controlling the positive and negative angular (or alternatively, up and down) movement of the steering arms 118, 134. The control unit 170 and the vehicle control electronics 150 may have additional functionality such as enabling the user to depress a button on the control unit to initiate the autonomous self righting of a fallen vehicle or to autonomously perform certain maneuvers.

Figure 9A:
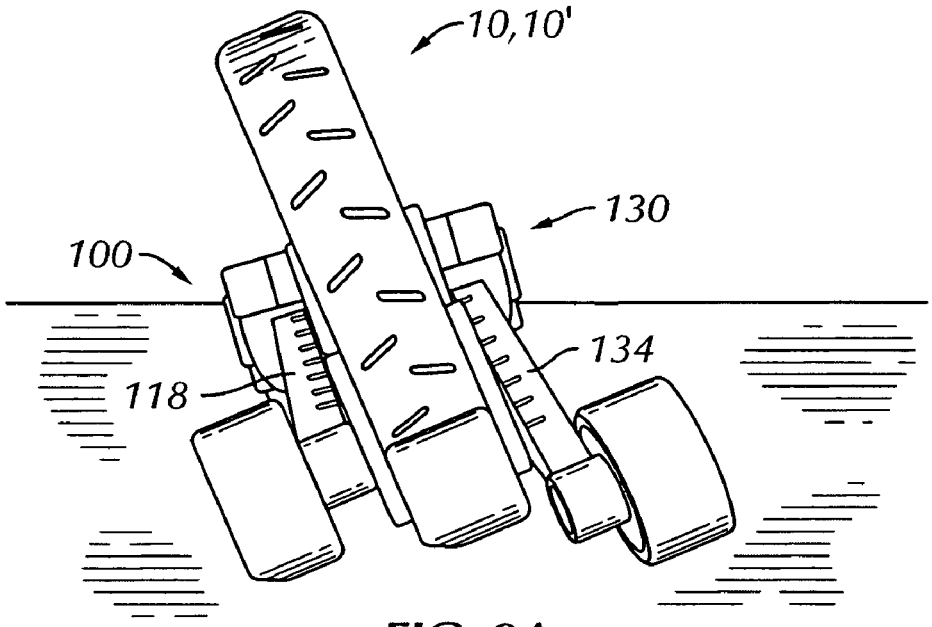
FIGS. 9A and 9B are rear perspective views of a rendering of the toy vehicle of FIG. 1, showing the vehicle in a left turn (FIG. 9A) and a right turn (FIG. 9B)
Figure 9B:
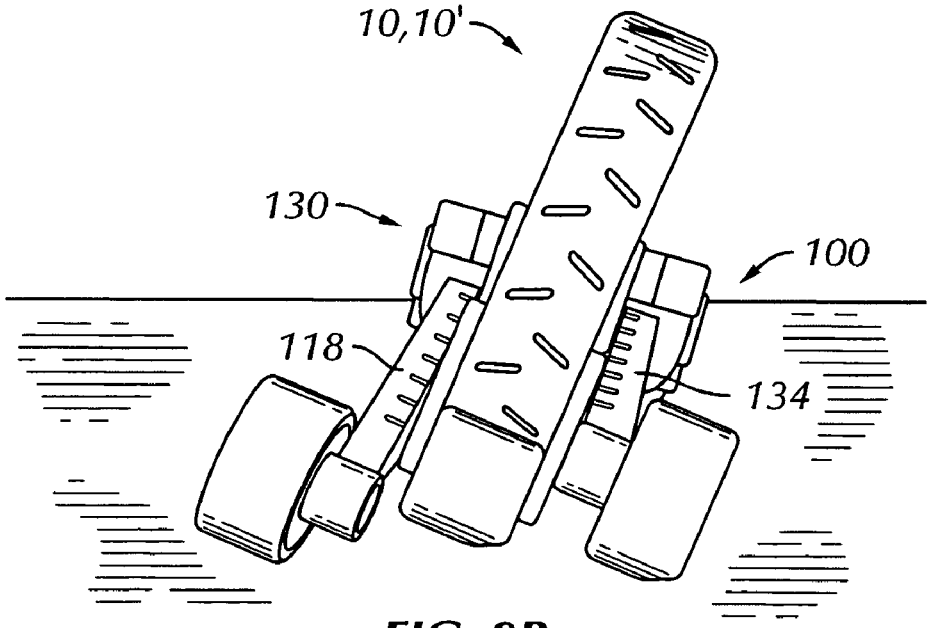

Referring to FIGS. 2 and 9A-9B, the toy vehicle 10 is steered by movement of the first and second steering arms 118, 134. In the illustrated embodiment, the first and second steering arms 118, 134 (and thereby also the first and second steering wheels 120, 136) rotate up and down in opposite directions on opposite sides of the driven wheel 30, causing the driven wheel 30 to tilt and lean into a turn. For example, to move the vehicle 10 forward or backward in a straight path, the first and second steering arms 118, 134 are positioned parallel to each other as shown in FIG. 2. For a left turn, the driven wheel 30 is tilted to the left by moving the first steering arm 118 upward with respect to the movement of the second steering arm 134 as shown in FIG. 9A. For a right turn, the driven wheel 30 is tilted to the right by moving the first steering arm 118 downward with respect to the movement of the second steering arm 134 as shown in FIG. 9B.

In other possible embodiments (not illustrated), the steering arm assemblies 100, 130 could be configured to rotate side to side, in a plane perpendicular or nearly perpendicular to the plane of rotation of the driven wheel 30, either about a single pivot axis or a pair of laterally separated pivot axes (four bar linkage). The former embodiment could be configured to steer the toy vehicle 10 by shifting the center of gravity of the toy vehicle. In the former embodiment, it may not be necessary to provide the first and second steering wheels 120, 136, as it may not be necessary for the steering arm assemblies 100, 130 to contact the ground to effect steering of the toy vehicle 10. However, steering wheels 120, 136 could also be provided in former alternative embodiment and the driven wheel 30 shifted by reverse torque from the steering motor. In the latter embodiment, the driven wheel 30 can be pitched by both reverse torque from the steering motor and the shift of the linkage and steering arms.

With reference again to FIG. 8, in yet another embodiment of the toy vehicle referred to as the vehicle 10', a second steering motor 98 is provided. The first steering motor 86 remains operably coupled to the first steering arm assembly 100, while the second steering motor 98 is separately and independently operably coupled to the second steering arm assembly 130, so that the steering arms 118, 134 may be separately and independently driven, either along separate non-synchronous paths, or along similar synchronized paths to permit parallel motion of the first and second steering arm assemblies 100, 130. Operation of the second steering motor 98 would be controlled by the controller 154 and a second steering motor control circuit 158. Preferably, in the second embodiment toy vehicle 10', the first and second steering arm assemblies are each capable of continuous full circular rotation (i.e. more than 360 degrees) relative to the drive assembly 50.

Figure 10A:
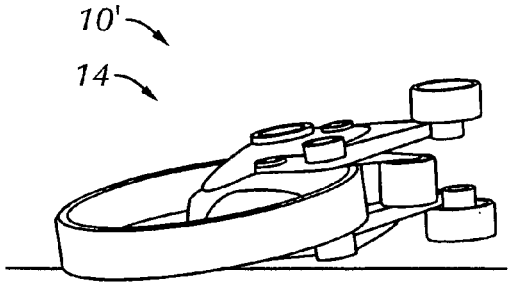
FIGS. 10A through 10F are a sequence of side perspective views of showing the orientation of the second embodiment toy vehicle in which the steering arms may move in parallel and the positions of the steering arms as the toy vehicle executes a self righting maneuver from an initial tipped over position (FIG. 10A) to an upright running position (FIG. 10F)
Figure 10B:
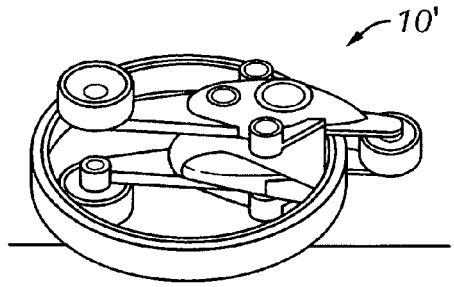
Figure 10C:
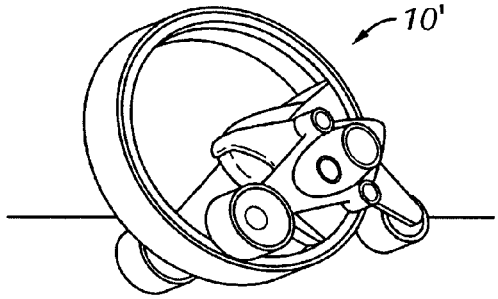
Figure 10D:
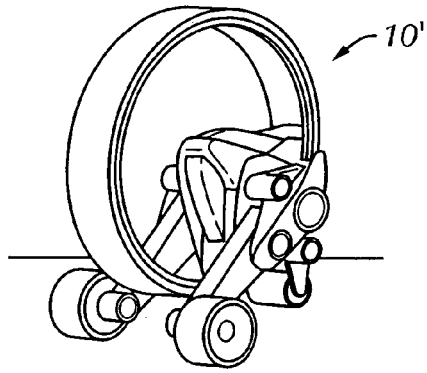
Figure 10E:
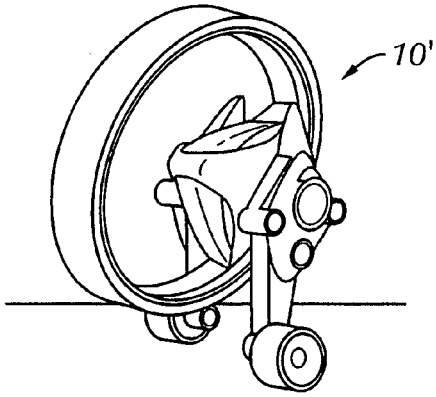
Figure 10F:
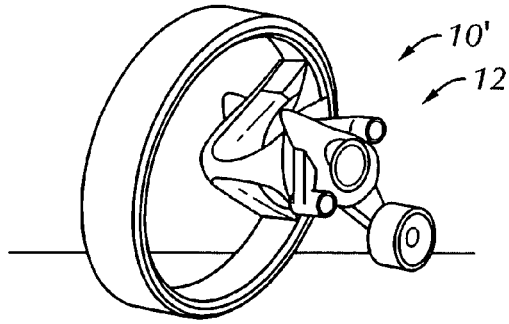

If the vehicle 10' should fall on its side into a tipped over position 14, as shown in FIG. 10A, rotating the first and second steering arms 118, 134 approximately 360 degrees will upright the vehicle to the vertical, upright running position 12. The sequence in FIGS. 10B-10F shows the successive stages of the up righting maneuver for the vehicle 10' in which the first and second steering motors 86, 98 are synchronized such that longitudinal axes 126 of the first and second steering arms 118, 134 remain parallel throughout the 360 degree rotation.

In view of the tilt angle θ discussed above, the first steering arm wheel assembly 120 cyclically moves toward and away from the driven wheel 30 as it rotates 360 degrees relative to the drive assembly 50. Referring to FIG. 11B, depending upon the magnitude of the tilt angle θ and other geometry of the vehicle 10', with the second embodiment toy vehicle 10' in the tipped over position 14, and with the steering arms 118, 134 rotated approximately 180 degrees from the angular position of the reaction wheel 140, the first and second steering arm wheels 120, 136 may move inwardly toward a central plane of the driven wheel 30, such that just the driven wheel 30 and reaction wheel 140 touch the ground.

Figure 11A:
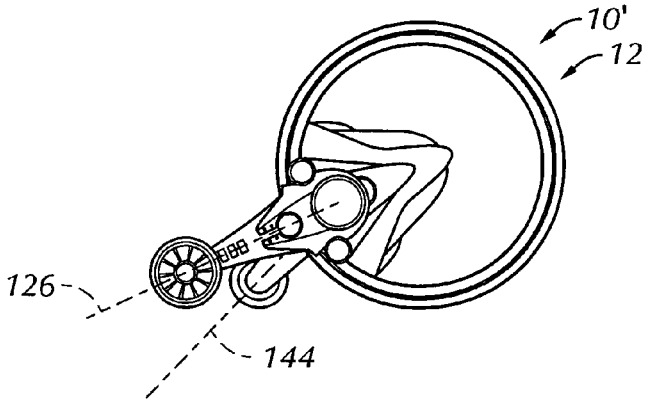
FIGS. 11A through 11E are a sequence of side perspective views of the second embodiment toy vehicle of FIGS. 10A-10F, showing the orientation and the positions of the steering arms as the toy vehicle executes an jumping maneuver from an initial position on a surface (FIG. 11A) to a fully airborne position (FIG. 11E).
Figure 11B:
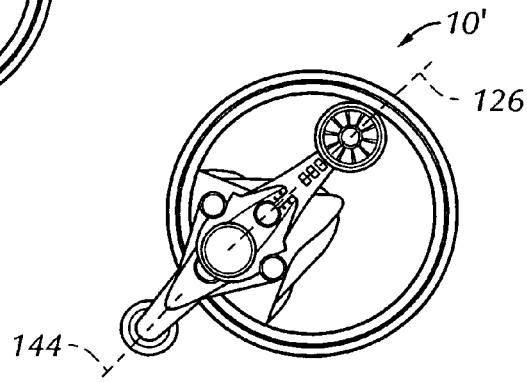
Figure 11C:
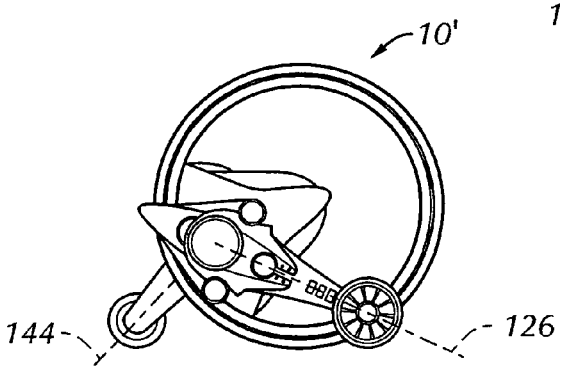
Figure 11D:
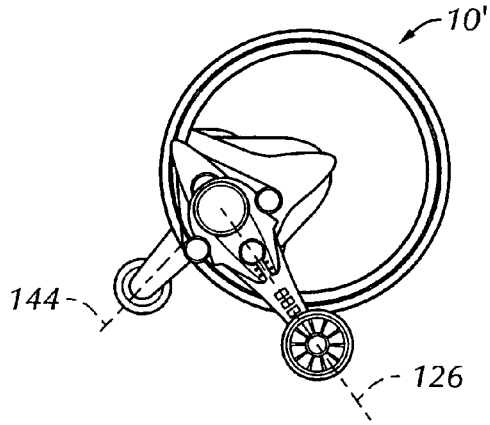
Figure 11E:
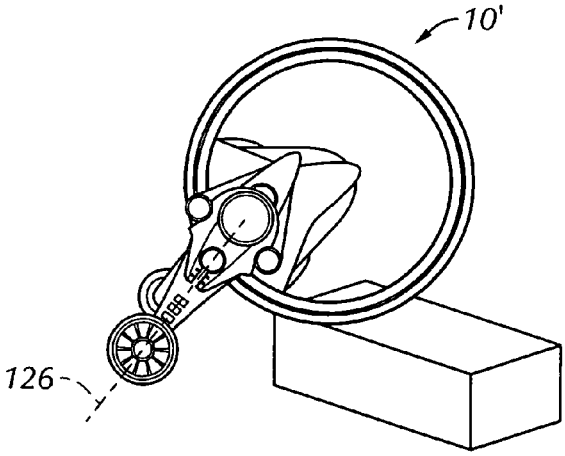

With reference now to FIGS. 11A-11E, the second embodiment toy vehicle 10' is capable of executing a jumping maneuver. In the upright running position 12, the reaction wheel 140 and steering wheels 120, 136 are in initial circumferential positions relative to the driven wheel 30 (FIG. 11A). The sequence of positions shown in FIGS. 11A-11E illustrate rapid rotation of steering wheels 120, 136 from their initial positions through a rotation of nearly 360 degrees, whereby the toy vehicle 10' is lifted from a supporting surface. Alternatively, the jumping maneuver could also be initiated by a sudden reversal of the direction of rotation of driven wheel 30.

Those skilled in the art will understand that changes could be made to the embodiments described above without departing from the broad inventive concept thereof. For example, some different steering arrangements have been identified. Also, instead of controlling the steering wheel arms 118 and 134 and driving the driven wheel 30 from within its inner circumference, it would be possible to move either or both functions to the outer circumferential side of the wheel. The reaction wheel 140 is preferred to reduce the loads on steering arms 118 and 134 but could be eliminated and the steering arms and wheels used to prevent the drive assembly 50 from rotating itself around the wheel 30. The reaction wheel 30 can be made ovoid instead of cylindrical or mounted to pivot about a second axis generally perpendicular to its central axis of rotation. The artisan will also understand that through manual control using the remote control unit 170 or additional predetermined commands, the vehicle 10, 10' may be made to perform a wide variety of maneuvers. It will further be understood that the controller may be programmed to automatically direct the vehicle through a sequence of maneuvers without remote control. It is understood, therefore, that this invention is not limited to the particular embodiments or maneuvers disclosed, but it is intended to cover foreseeable modifications within the spirit and scope of the present invention as defined by the appended claims.

What is claimed is:

1. A toy vehicle comprising:

a driven wheel having first and second lateral sides, a central axis of rotation through the lateral sides, and inner and outer circumferential sides around the central axis;

a drive assembly operably mounted on the driven wheel and including:

a drive motor; and a drive member operably spaced radially from the central axis of rotation and coupling the drive motor with the driven wheel along at least one of the first and second lateral and inner and outer circumferential sides of the driven wheel; and a separately operable steering assembly mounted on the driven wheel and including:

a first steering arm supported for rotation with respect to the driven wheel and supporting a first steering wheel for rotation on the first lateral side of the driven wheel;

a second steering arm supported for rotation with respect to the driven wheel and supporting a second steering wheel for rotation on the second lateral side of the driven wheel; and;

a first steering motor operably coupled with at least the first steering arm to rotate at least the first steering arm relative to the driven wheel so as to effect steering of the driven wheel with at least the first steering arm and first steering wheel.

2. The toy vehicle of claim 1, wherein the drive assembly is positioned within an interior of the driven wheel.

3. The toy vehicle of claim 1, wherein the drive assembly is positioned along the driven wheel on the inner circumferential side of the driven wheel.

4. The toy vehicle of claim 1, wherein the drive assembly is movably mounted on a rim of the driven wheel.

5. The toy vehicle of claim 1 wherein each of the first and second steering arms has a first end and a second end, the first end of each steering arm being rotatably connected with the drive assembly and the second end rotatably supporting the steering wheel.

6. The toy vehicle of claim 1 further wherein the first steering motor is also operatively coupled with the second steering arm to rotate the second steering arm.

7. The toy vehicle of claim 6 wherein the first steering motor simultaneously rotates the first and second steering arms.

8. The toy vehicle of claim 7, wherein a common plane and wherein the first and second steering wheels are supported on a side of the reaction wheel generally distal to and facing generally away from the driven wheel.

9. The toy vehicle of claim 1 further comprising a reaction wheel supported from the driven wheel outside the driven wheel for rotation in a common plane of rotation with the driven wheel.

10. The toy vehicle of claim 9 wherein the reaction wheel is rotatably supported by at least one reaction wheel support fixedly connected with the drive assembly.

11. The toy vehicle of claim 1 wherein the drive member is a wheel frictionally engaged with the driven wheel.

12. The toy vehicle of claim 1 in combination with a wireless controller including a transmitter, the toy vehicle further comprising control electronics including a receiver adapted to receive command signals from the transmitter and a controller adapted to generate control signals to at least the drive motor and the first steering motor to control operation of the toy vehicle.

13. The toy vehicle of claim 12, further comprising first and second sensors operably coupled to the controller and adapted to detect a rotational position of the first and second steering arm assemblies, respectively.

14. The toy vehicle of claim 1 wherein at least the first steering arm is configured for continuous circular rotation by the first steering motor relative to the drive assembly.

15. The toy vehicle of claim 1 further comprising:

a second steering motor operably coupled to the second steering arm for rotation of the second steering arm relative to the drive assembly.

16. The toy vehicle of claim 15 wherein each of the first and second steering arms is configured for continuous circular rotation relative to the drive assembly.

17. The toy vehicle of claim 16, wherein the first and second steering arms rotate in first and second planes of rotation, respectively, which are each non-parallel to a plane of rotation of the driven wheel.

18. The toy vehicle of claim 16 in combination with a wireless controller including a transmitter, the toy vehicle further comprising control electronics including a receiver adapted to receive command signals from the transmitter and a controller adapted to generate control signals to the drive motor and the first and second steering motors to control operation of the toy vehicle.

19. The toy vehicle of claim 18, further comprising first and second sensors operably coupled to the controller and adapted to detect a rotary position of the first and second steering arms, respectively.

20. A toy vehicle comprising:

a driven wheel having first and second lateral sides, a central axis of rotation though the lateral sides, and inner and outer circumferential sides around the central axis;

a drive assembly operably mounted on the driven wheel and including:

a drive motor; and a drive member operably spaced radially from the central axis of rotation and coupling the drive motor with the driven wheel along at least one of the first and second lateral and inner and outer circumferential sides of the driven wheel; and a steering assembly operably mounted on the driven wheel and including:

a first steering arm supported for rotation with respect to the driven wheel and supporting a first steering wheel for rotation on the first lateral side of the driven wheel;

a second steering arm supported for rotation with respect to the driven wheel and supporting a second steering wheel for rotation on the second lateral side of the driven wheel; and a first steering motor operably coupled with at least the first steering arm to rotate at least the first steering arm relative to the driven wheel so as to effect steering of the driven wheel with at least the first steering arm and first steering wheel;

wherein the drive assembly further includes a plurality of idler wheels rotatably engaged with the driven wheel so as to movably secure the drive assembly to the driven wheel.

21. A toy vehicle comprising:

a driven wheel having first and second lateral sides, a central axis of rotation through the lateral sides, and inner and outer circumferential sides around the central axis:

a drive assembly operably mounted on the driven wheel and including:

a drive motor; and a drive member operably spaced radially from the central axis of rotation and coupling the drive motor with the driven wheel along at least one of the first and second lateral and inner and outer circumferential sides of the driven wheel; and a separately operable steering assembly operably mounted on the driven wheel and including:

a first steering arm supported for rotation with respect to the driven wheel and supporting a first steering wheel for rotation on the first lateral side of the driven wheel;

a second steering arm supported for rotation with respect to the driven wheel and supporting a second steering wheel for rotation on the second lateral side of the driven wheel; and a first steering motor operably coupled with at least the first steering arm to rotate at least the first steering arm relative to the driven wheel so as to effect steering of the driven wheel with at least the first steering arm and first steering wheel;

wherein the steering assembly is a separate assembly mounted to the drive assembly.

22. A toy vehicle comprising:

a driven wheel having first and second lateral sides, a central axis of rotation through the lateral sides, and inner and outer circumferential sides around the central axis;

a drive assembly operably mounted on the driven wheel and including:

a drive motor; and a drive member operably spaced radially from the central axis of rotation and coupling the drive motor with the driven wheel along at least one of the first and second lateral and inner and outer circumferential sides of the driven wheel; and a steering assembly operably mounted on the driven wheel and including:

a first steering arm supported for rotation with respect to the driven wheel and supporting a first steering wheel for rotation on the first lateral side of the driven wheel;

a second steering arm supported for rotation with respect to the driven wheel and supporting a second steering wheel for rotation on the second lateral side of the driven wheel; and a first steering motor operably coupled with at least the first steering arm to rotate at least the first steering arm relative to the driven wheel so as to effect steering of the driven wheel with at least the first steering arm and first steering wheel;

wherein the first and second steering arms rotate in first and second planes of rotation, respectively, which are each non-parallel to a plane of rotation of the driven wheel.

23. A toy vehicle comprising:

a driven wheel having first and second lateral sides, a central axis of rotation though the lateral sides, and inner and outer circumferential sides around the central axis;

a drive assembly operably mounted on the driven wheel and including:

a drive motor; and a drive member operably spaced radially from the central axis of rotation and coupling the drive motor with the driven wheel along at least one of the first and second lateral and inner and outer circumferential sides of the driven wheel; and a steering assembly operably mounted on the driven wheel and including:

a first steering arm supported for rotation with respect to the driven wheel and supporting a first steering wheel for rotation on the first lateral side of the driven wheel;

a second steering arm supported for rotation with respect to the driven wheel and supporting a second steering wheel for rotation on the second lateral side of the driven wheel; and a first steering motor operably coupled with at least the first steering arm to rotate at least the first steering arm relative to the driven wheel so as to effect steering of the driven wheel with at least the first steering arm and first steering wheel;

wherein the driven wheel includes a rim and lacks a hub within the rim.

24. The toy vehicle of claim 23 wherein the drive assembly is coupled with the rim.

25. The toy vehicle of claim 24 wherein the steering assembly is supported from the rim on the drive assembly.

* * * * *